US005657984A

United States Patent [19]

Leo

[11] Patent Number: 5,657,984

[45] Date of Patent: Aug. 19, 1997

[54] BALL PITCHING MACHINE

[76] Inventor: Robert S. Leo, 947 Main St., Yarmouthport, Mass. 02675

[21] Appl. No.: 326,063

[22] Filed: Oct. 19, 1994

Related U.S. Application Data

[63] Continuation of Ser. No. 44,541, Apr. 5, 1993, abandoned, which is a continuation of Ser. No. 851,681, Mar. 12, 1992, abandoned.

[51] Int. Cl.[6] ..... A63B 69/40

[52] U.S. Cl. ..... 124/20.1; 124/17; 473/451

[58] Field of Search ..... 273/26 R, 29 A, 273/181 A; 124/1, 16, 17, 18, 20.1, 41.1

[56] References Cited

U.S. PATENT DOCUMENTS

| | | | |
|---|---|---|---|
| 300,415 | 1/1884 | Allen | 124/17 |
| 2,162,438 | 6/1939 | Letarte | 273/26 A |
| 2,282,315 | 5/1942 | Adams | 124/17 |
| 3,011,784 | 12/1961 | Segretto | 273/26 A |
| 3,277,878 | 10/1966 | Pankratz | 124/20.1 |
| 3,802,409 | 4/1974 | Mike | 124/20.1 |
| 4,198,949 | 4/1980 | Cook | 124/20.1 |
| 4,873,964 | 10/1989 | Bonoan | 124/20.1 |
| 5,249,564 | 10/1993 | Peachey | 124/17 |

FOREIGN PATENT DOCUMENTS

| | | | |
|---|---|---|---|
| 632976 | 6/1936 | Germany | 124/17 |
| 654816 | 6/1951 | United Kingdom | 124/17 |
| 665518 | 1/1952 | United Kingdom | 124/17 |

*Primary Examiner*—Theatrice Brown

[57] ABSTRACT

A machine for employing the recoil effect of four rubber cords (F) to propel balls at a target for hitting by a batter or as a game of accuracy. The rubber cords are secured to two support poles (A) inserted into the ground and stabilized by four guide wires (D) staked at the front and rear of each pole. These guide wires are offset to the outside of each pole about two feet. An alignment device (B) consisting of a 4'×5' mat with a line drawn up its center is used to properly align the support poles with a target (C). A harness (G) having a hole in the middle about 1" in diameter or a pouch into which a ball is placed is also attached to the four rubber cords. The harness is folded over the ball and drawn by hand to a aiming rod (E) which is staked at the end of the center line of the alignment device away from the target. By adjusting the aiming rod left or right and aligning the calibrations on the harness (H) with those on the aiming rod (I), accuracy in hitting the target can be achieved. The speed of the ball can be adjusted by restaking or slanting the aiming rod forward or backwards. The target cut to about the size of a baseball "strike-zone" and which can adjust in elevation and height can be used as an automatic umpire for batting or for a game of accuracy.

11 Claims, 4 Drawing Sheets

BALL PITCHING MACHINE

CROSS-REFERENCE TO RELATED APPLICATIONS

This is a cont. of Ser. No. 44,541, filed Apr. 5, 1993, now abandoned, which is a cont. of Ser. No. 851,681, filed Mar. 12, 1992, now abandoned.

BRIEF SUMMARY OF THE INVENTION

This is a pitching machine designed to propel balls toward a target or batter by using the recoil effect of four (4) heavy-duty rubber cords or springs attached to two support poles with the use of an aiming device to direct the flight of the balls.

BRIEF DESCRIPTION OF THE VIEW OF THE DRAWINGS

FIG. 1, Sheet 1/4 shows the left side of the machine with the adjustable support poles (A) staked at the two corners of the alignment device (B) closest to the target (C) and stabilized by four guide wires (D) to the front and rear of each pole. Hitch pins (E) placed in one of the holes of the support poles allow the poles to be adjusted, and retractors (F) are attached to the guide wires which allow the wires to retract. The aiming rod (G) is staked near the end of the center line (B1) of the alignment device opposite the target. The four detachable rubber cords or springs (H) are connected to the support poles and the harness (I). The rubber cords are seen being pulled back and the harness aligned with the aiming rod to direct the ball toward the target. The harness is aligned with one of the vertical calibrations on the aiming rod (J) to direct the flight of the ball (L). Handles (K) are attached to the harness are used to extend the rubber cords.

FIG. 2, Sheet 2/4 shows a side view of the harness (I) attached to the four rubber cords (H) in the process of opening and propelling a ball (L) toward the target. The rear portion of the ball is protruding through an aperture (M) about two inches in diameter cut into the center of the harness. Two handles (K) are attached to the harness, and the ball (L) is secured in place by two pieces of crescent-shaped foam rubber (N).

FIG. 3, Sheet 3/4 shows the rear of the target (C) with a hitch pin (C1) place through the adjustable pipe (C2) which sits on top of a metal rod (C3) staked into the ground. The adjustable top panel of the target (C4) is connected by hinges (C5) and barrel bolts (C6). Two rubberized guide wires (C7) stabilize the target as does the disk (C8) through which the metal rod is staked.

FIG. 4, Sheet 4/4 shows the aiming rod (G) which is sectioned into three pieces (G1), (G2) and (G3) that are connected by bolts (G4) and (G5) to allow the top piece (G1) to adjust left and right and to allow both the top two pieces (G1) and (G2) to simultaneously adjust forward and backward. The top piece has vertical calibrations (J), and there are round gauges (G6) and (G7) at both connections. The aiming rod is staked into the ground via a metal rod (G8) and stabilized by a disk (G9).

DETAILED DESCRIPTION

Figure 1:
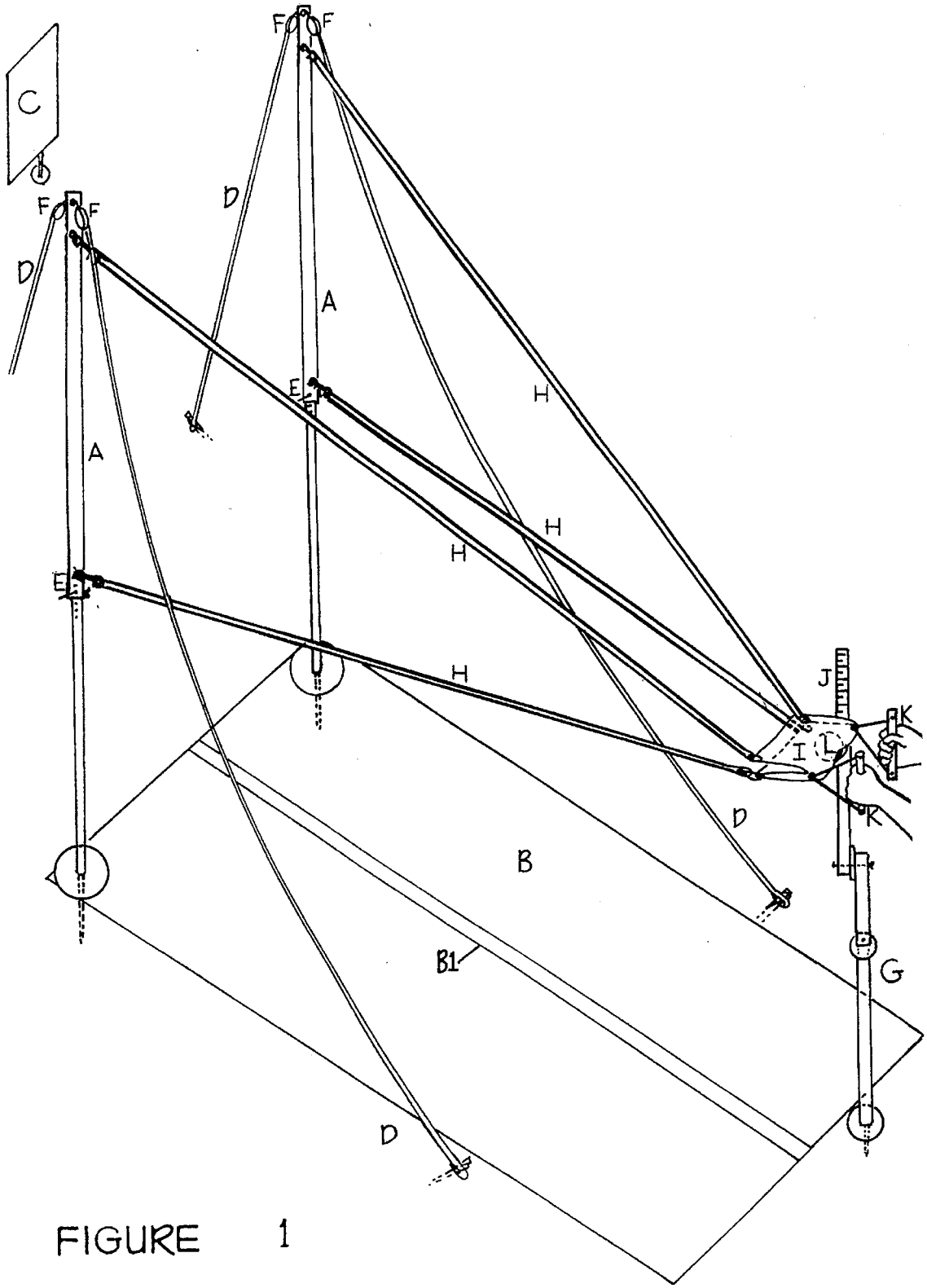
Figure 2:
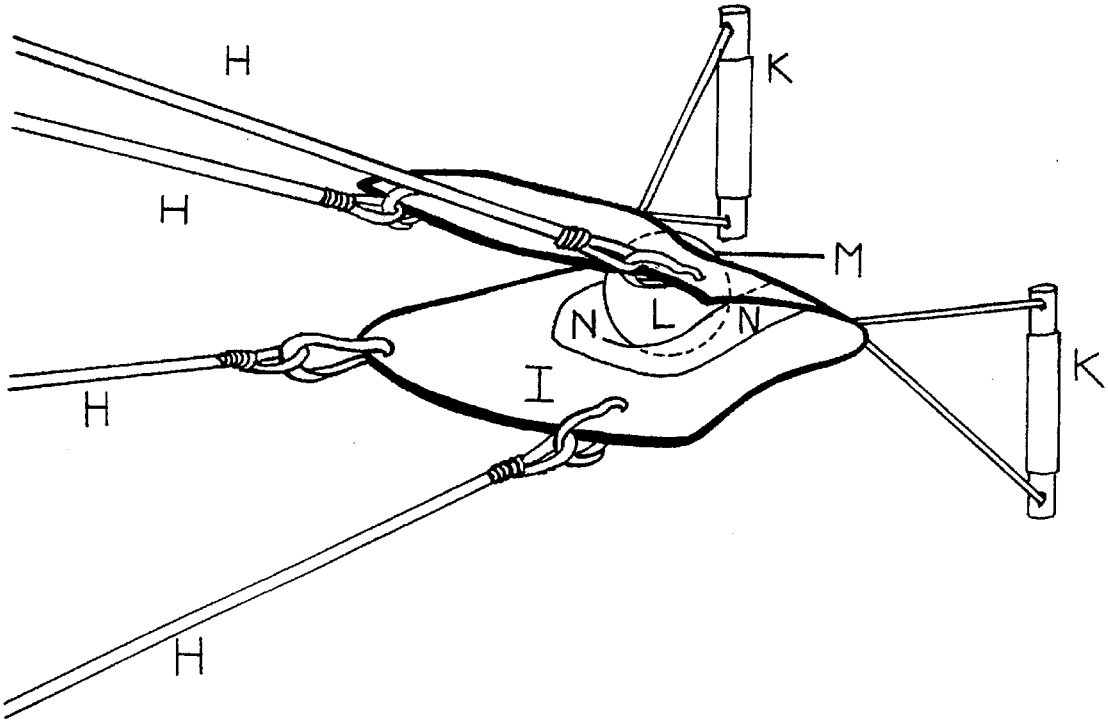
Figure 3:
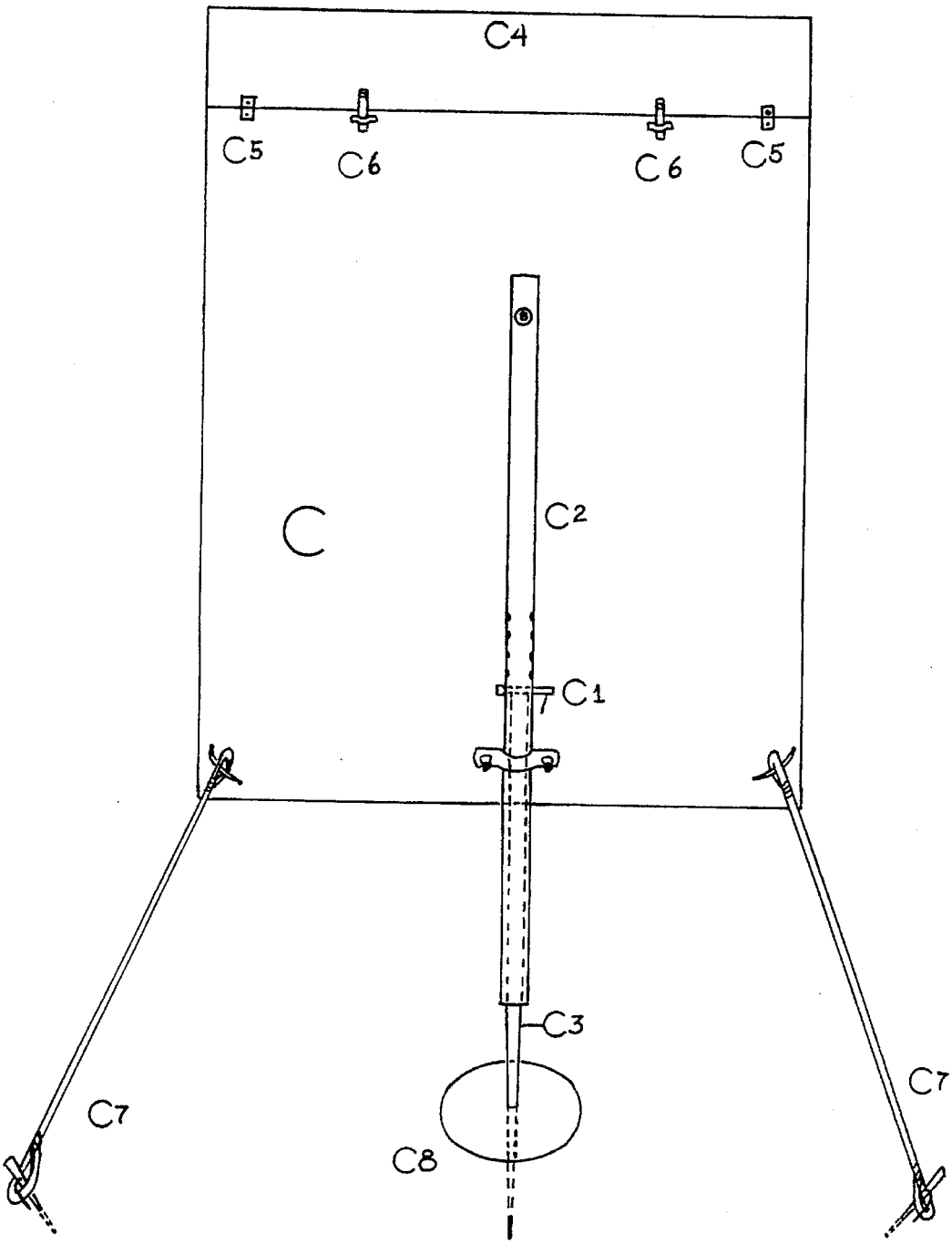
Figure 4:
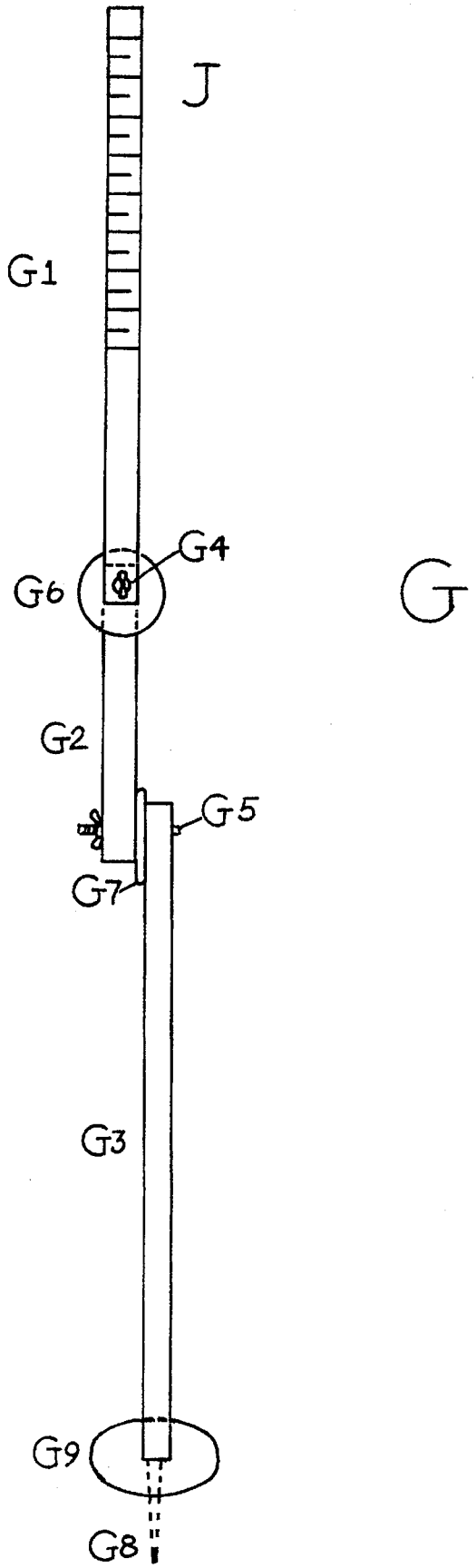

This pitching machine consists of two support poles made of aluminum, metal or plastic which stand approximately six feet in height. Each poles may be constructed so that the top half slides down over or into the bottom half so that it may be adjusted in height for aiming the machine or for transporting it. The poles are staked into the ground about four feet apart and are aligned toward a target with the aid of an alignment device consisting of a mat measuring about four feet in width and four and one-half feet in length. A line drawn lengthwise down the center of the mat is pointed at the target.

The support poles are staked at the two corners of the mat closest to the target and a smaller pole, the aiming rod, which is about four feet in height is staked at the end of the center line opposite the target. Dowels may be inserted at the bottom of each pole and ⅜" grooved, metal rods secured in the dowels with 8" to 10" of rod extending from the bottom of each pole to facilitate staking them into the ground. The mat may be removed once the three poles have been set in place. There are verticle calibrations at the upper end of the aiming rod and the aiming rod can be adjusted laterally, foward and backwards simply by pushing it in the desired direction and firming the ground to keep it steady. Two guide wires extending approximately eight to ten feet to the front and rear of and about two feet to the outside of each support pole are then staked into place. A device similar to that employed in a retractable tape measure may be utilized to retract the guide wires in order to facilitate storage and transportation of the machine. Clips can be attached to the ends of the guide wires so they can be detached from the support poles.

Four heavy rubber cords or springs attached to the four corners of a harness are then connected to the support poles, two on each pole. Clips are attached to the end of the rubber cords to allow them to be detached from the support poles. A harness is attached to the other ends of the cords. The harness is about 12" by 12" in size and is made of leather or some other durable and flexible material. A ball is then placed in a small hole about an inch in diameter or pouch which is the diameter of the ball being propelled and located in the middle of the harness. The harness contains horizontal calibrations along the rear of the fold which is created when it is doubled over to encompass the ball.

The harness is then pulled backward by hand from the target stretching the rubber cords or springs. The harness is aligned with a calibration on the aiming rod and then released. The aiming rod is adjusted forward, backward or from side to side until the balls are properly directed at the target. The target is made of durable plastic or wood about ½" in thickness, 19" in width and about 24" in height from its top to bottom edges. A single pipe attached to the back side of the target allows the target to sit atop a metal stake or rod placed into the ground, and by drilling holes through the pipe about 3" apart though which a pin can be inserted in the appropriate hole, the target's elevation can be adjusted to the height of a batter. A common screw-type arrangement can be used instead of a pin-type arrangement. Also, the target can be cut laterally about 6" from the top and hinged so that the height of the target can be also be adjusted to the height of a batter. Guide wires made of rubber cords are used to stabilize the target. Once the aiming rod has been adjusted, accuracy is achieved by aligning the calibrations on the harness with the calibrations on the aiming rod and releasing the harness the same way for each pitch. To make the pitch go higher, lengthen the height of the support poles and/or use a lower calibration on the aiming rod, and vice versa. To make the ball go further right, slant or restake the aiming rod to the left and/or use a calibration on the harness closer to the right edge of the harness, and vice versa. The target serves as an automatic umpire.

I, Robert S. Leo, claim the following as my original and novel invention:

1. A ball pitching apparatus comprising:

(a) two stationary spaced apart vertical support poles;

(b) expandable cords, each having two ends, a first end of said two ends, of at least one cord being attached to one of said support poles and the first end of said two ends of at least one other cord being attached to the other of said support poles;

(c) a harness attached to a second end of each expandable cord only, said harness being configured for releasably receiving a ball;

(d) a vertical stationary aiming rod positioned a predetermined distance from and unattached from the support poles.

2. A ball pitching apparatus of claim 1 wherein the support poles are adjustable in height.

3. A ball pitching apparatus of claim 1 further comprising a means of stabilizing the support poles in a vertical position.

4. A ball pitching apparatus of claim 1 further comprising means to align the aiming rod relative to the support poles.

5. A ball pitching apparatus as defined in claim 1 wherein, said aiming rod is compresed of first, second and third sections, said first section being attached to a support surface; said second section being pivotally attached at one end thereof to the upper end of said first section by a first pivot means, and said third section having one end thereof pivotally attached to the other end of said second section by a second pivot means; said first pivot means allowing mannual pivoting of said second and third sections in a direction substantially parallel to the intended flight of a ball being projected, and said second pivot means allowing manual pivoting of said third section in a direction substantially transverse to the intended flight of a ball being projected.

6. A ball pitching apparatus comprising:

(a) two stationary spaced apart vertical support poles stabilized by means of guide wires;

(b) expandable cords, each having two ends, a first end of said two ends of at least one cord being attached to one of said support poles and the first end of said two ends of at least one other cord being attached to the other of said support poles;

(c) a harness attached to a second end of each expandable cord only, said harness being configured for releasably receiving a ball;

(d) a vertical stationary aiming rod positioned a predetermined distance from and unattached from the support poles.

7. A ball pitching apparatus of claim 6 wherein the support poles are adjustable.

8. A ball pitching apparatus of claim 6 wherein handles are attached to the harness.

9. A ball pitching apparatus of claim 6 wherein the aiming rod comprises means to manually adjust a portion of said aiming rod laterally, forward and backward.

10. A ball pitching apparatus of claim 6 further comprising a mat for allowing manual alignment of said support poles relative to said aiming rod.

11. A ball pitching apparatus of claim 6 further comprising means to retract the guide wires when not in use.

* * * * *